US008259042B2

(12) United States Patent
Tada et al.

(10) Patent No.: US 8,259,042 B2
(45) Date of Patent: Sep. 4, 2012

(54) VARYING THE PEAK LUMINANCE OF A DISPLAY PANEL WITH COMPARISON OF THE MEAN GRADATION VALUE OF A CURRENT FRAME AND MEAN GRADATION VALUES AVERAGED OVER A PERIOD OF SEVERAL FRAMES

(75) Inventors: Mitsuru Tada, Kanagawa (JP); Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 978 days.

(21) Appl. No.: 11/600,885

(22) Filed: Nov. 17, 2006

(65) Prior Publication Data

US 2007/0176861 A1 Aug. 2, 2007

(30) Foreign Application Priority Data

Nov. 25, 2005 (JP) ..... P2005-340434

(51) Int. Cl.
*G09G 3/30* (2006.01)

(52) U.S. Cl. ..... 345/77; 345/63

(58) Field of Classification Search ..... 345/77, 345/82, 509–605, 103, 60–63; 359/237–324; 713/300

See application file for complete search history.

(56) References Cited

U.S. PATENT DOCUMENTS 5,432,566 A * 7/1995 Tanaka et al. ..... 348/687
5,757,343 A * 5/1998 Nagakubo ..... 345/63
6,278,421 B1 * 8/2001 Ishida et al. ..... 345/63
6,806,852 B2 * 10/2004 Ishizuka et al. ..... 345/77
2002/0158971 A1 * 10/2002 Daiku et al. ..... 348/226.1
2003/0025718 A1 * 2/2003 Mori ..... 345/690
2004/0178974 A1 * 9/2004 Miller et al. ..... 345/82
2004/0257316 A1 * 12/2004 Nguyen ..... 345/87
2005/0231449 A1 * 10/2005 Miyagawa ..... 345/77

(Continued)

FOREIGN PATENT DOCUMENTS

JP 2001-013914 A 1/2001

(Continued)

OTHER PUBLICATIONS

Japanese Office Action issued Aug. 2, 2011 for corresponding Japanese Application No. 2005-340434.

*Primary Examiner* — Kevin Nguyen
*Assistant Examiner* — Liliana Cerullo
(74) *Attorney, Agent, or Firm* — Rader Fishman & Grauer, PLLC

(57) ABSTRACT

A self-luminous display apparatus capable of varying a peak luminance of a display panel in a unit of one frame, which includes: a mean gradation value calculation section configured to calculate a mean gradation value of a video signal in a unit of a frame for each one frame; a specific condition detection section configured to detect, based on the mean gradation values calculated over a period of several frames, an input of the video signal which satisfies a specific condition in which a drop of a physical peak luminance is not likely to be perceived visually; and a light emission condition control section configured to perform dropping control of the peak luminance in a unit of a frame so that a dropping condition set in advance may be satisfied for a period of time after the frame which satisfies the specific condition is detected until the detection state is canceled.

18 Claims, 14 Drawing Sheets

U.S. PATENT DOCUMENTS

2006/0082689 A1* 4/2006 Moldvai ..... 348/678

FOREIGN PATENT DOCUMENTS

JP 2001-075529 A 3/2001
JP 2001-092412 A 4/2001
JP 2002-116732 A 4/2002
JP 5-17826 6/2002
JP 2002-169509 6/2002
JP 2003-150110 5/2003
JP 2005-308857 A 11/2005

* cited by examiner

VARYING THE PEAK LUMINANCE OF A DISPLAY PANEL WITH COMPARISON OF THE MEAN GRADATION VALUE OF A CURRENT FRAME AND MEAN GRADATION VALUES AVERAGED OVER A PERIOD OF SEVERAL FRAMES

CROSS REFERENCES TO RELATED APPLICATIONS

The present invention contains subject matter related to Japanese Patent Application JP 2005-340434 filed with the Japanese Patent Office on Nov. 25, 2005, the entire contents of which are incorporated herein by reference.

BACKGROUND OF THE INVENTION

1. Field of the Invention

This invention relates to a self-luminous display apparatus, a light emission condition control apparatus, a light emission condition control method and a program.

2. Description of the Related Art

An organic EL display apparatus is superior not only in the wide view angle characteristic, the high response speed, the wide color reproduction range and the high contrast but also in that it allows a display panel itself to be formed with a small thickness. Thanks to the advantages mentioned, an organic EL display apparatus draws attention as the most promising candidate for a next-generation flat panel display apparatus.

However, in order to use an organic EL display apparatus in audio-visual applications of a television program, it is necessary to further improve the light emission characteristic of light emitting elements.

However, a very long time and massive expenditures are consumed for the development of an organic EL element which is used to form a display element, particularly for the development of a material for an organic EL element. Therefore, a method of improving the driving method for an organic EL element to improve the life of the organic EL element is demanded.

For example, Japanese Patent Laid-Open No. 5-17826 (hereinafter referred to as Patent Document 1) discloses a method of detecting a variation amount of a driving voltage for a light emitting element and controlling a constant current driving signal in response to the variation amount.

Meanwhile, Japanese Patent Laid-Open No. 2003-150110 (hereinafter referred to as Patent Document 2) discloses a method of applying a reverse bias to an organic EL element while the organic EL element does not emit light so that the organic EL element may not be deteriorated.

Further, Japanese Patent Laid-Open No. 2002-169509 (hereinafter referred to as Patent Document 3) discloses a method of positively discharging a charge held in a capacitor of a pixel circuit to suppress unnecessary light emission time.

SUMMARY OF THE INVENTION

However; the method disclosed in Patent Document 1 prevents a drop of the luminance by adjusting the amount of current with respect to a drop of the luminance of each pixel and merely accelerates dropping of the luminance of the display element. Accordingly, the life of the organic EL panel may not be improved.

Meanwhile, the method disclosed in Patent Document 2 may not improve the life positively, although it can make improvements against the drop of the luminance arising from leak current.

Also, the method disclosed in Patent Document 3 may not improve the life positively, although it can make improvements against the drop of the luminance arising from unnecessary light emission time.

Therefore, it is demanded to provide a self-luminous display apparatus, a light emission condition control apparatus, a light emission condition control method and a program wherein, where the peak luminance of a display panel can be variably controlled in a unit of one frame, the peak luminance can be reduced actively while the peak luminance perceived by a visual sense is maintained.

According to an embodiment of the present invention, there is provided a self-luminous display apparatus capable of varying a peak luminance of a display panel in a unit of one frame, including a mean gradation value calculation section configured to calculate a mean gradation value of a video signal in a unit of a frame for each one frame, a specific condition detection section configured to detect, based on the mean gradation values calculated over a period of several frames, an input of the video signal which satisfies a specific condition in which a drop of a physical peak luminance is not likely to be perceived visually, and a light emission condition control section configured to perform dropping control of the peak luminance of the display panel in a unit of a frame so that a dropping condition set in advance may be satisfied for a period of time after the frame which satisfies the specific condition is detected until the detection state is canceled.

With the self-luminous display apparatus, the peak luminance can be dropped actively while the peak luminance perceived by a visual sense is maintained. As a result, an increase of the life of the display panel can be achieved without having an influence on the picture quality of an image displayed on the display panel. Simultaneously, a reduction of the power consumption by the display panel can be achieved.

The above and other objects, features and advantages of the present invention will become apparent from the following description and the appended claims, taken in conjunction with the accompanying drawings in which like parts or elements are denoted by like reference symbols.

BRIEF DESCRIPTION OF THE DRAWINGS

FIG. 12 is a flow chart illustrating an example of calculation of a drop amount a;

DETAILED DESCRIPTION OF THE PREFERRED EMBODIMENT

In the following, a self-luminous display apparatus to which the present invention is applied is described, taking an organic EL panel module incorporating a processing function which can be implemented by the present invention as an example.

It is to be noted that, to matters which are not specifically described herein or not specifically illustrated in the accompanying drawings, well-known or publicly known techniques in the pertaining technical field are applied.

(A) Adjustment of the Peak Luminance

If the peak luminance drops by a % within a period within which a display panel is used, then the reliability time of the display panel can be improved by approximately a %. For example, a drop of the peak luminance by 10% can improve the reliability time by approximately 10%. Naturally, if the peak luminance decreases, then also a reduction in power consumption can be achieved.

Therefore, a technique of adjusting the peak luminance of a display panel is described.

The luminance of a display panel can be adjusted by variably controlling the output voltage (output current) applied to a display element or the light emission time period of a display element when maximum data are inputted.

Figure 1:
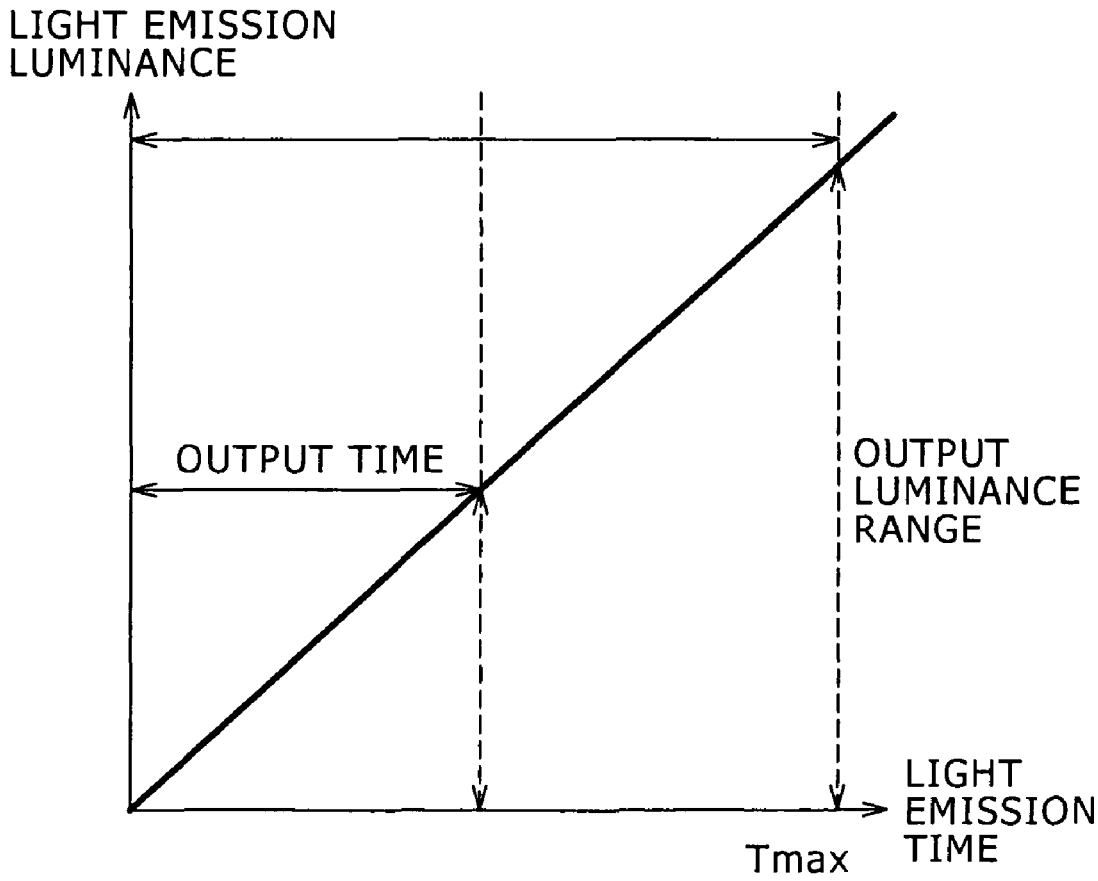
FIG. 1 is a diagram illustrating a relationship between the light emission time period and the light emission luminance.

FIG. 1 illustrates a relationship between the light emission time period and the light emission luminance. As seen in FIG. 1, the light emission luminance varies linearly with respect to the light emission time period.

Figure 2A:
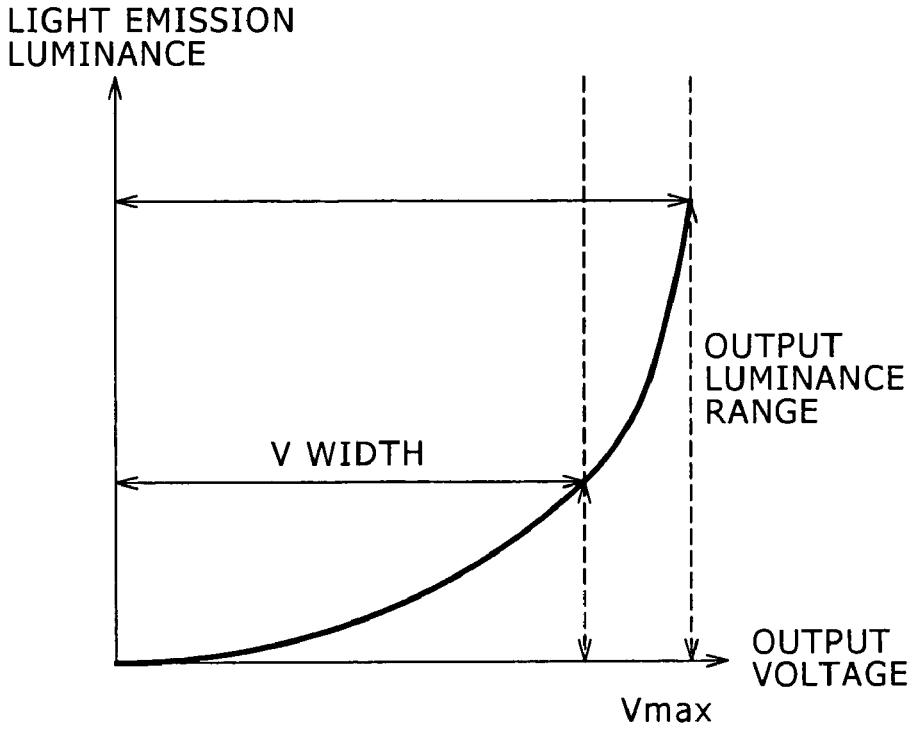
FIGS. 2A and 2B are diagrams illustrating relationships between the output voltage and the light emission luminance.
Figure 2B:
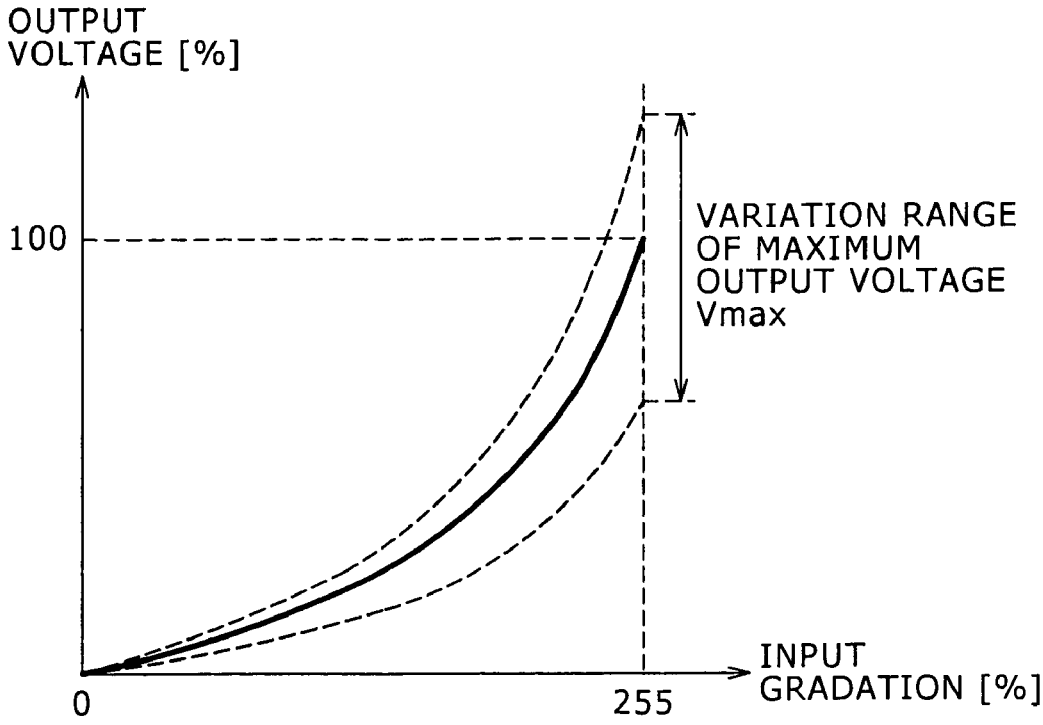

FIG. 2A illustrates a relationship between the output voltage applied to a display element and the light emission luminance of the display element. FIG. 2B illustrates an input/output relationship between the gradation value (%) of an input video signal and the output voltage applied to the display element. The reference voltage for the output voltage is represented by 100%.

In FIG. 2B, a curve indicated by a solid line indicates an input/output relationship corresponding to the reference value. Meanwhile, each curve indicated by a broken line indicates an input/output relationship where the maximum output voltage Vmax (maximum output current Imax) applied to the display element when maximum data is inputted is variably controlled. As seen from FIGS. 2A and 2B, the light emission luminance is variably controlled if the maximum output voltage Vmax (maximum output current Imax) is variably controlled even if the input gradation value is equal.

The peak luminance of the display panel is given by the product S of the output voltage Vmax (output current Imax) and the light emission time period.

Accordingly, if the light emission time period or the output voltage Vmax (output current Imax) is variably controlled individually, then the peak luminance of the display panel can be variably controlled.

(B) Specific Condition in which a Drop of a Physical Peak Luminance is not Likely to be Perceived Visually As described above, if the peak luminance can be decreased, then an increase of the like and a reduction of the power consumption of the display panel can be achieved. However, it is necessary to avoid a situation in which the drop of the peak luminance is perceived by a human being and is recognized as a deterioration of the picture quality.

The inventors of the present invention have confirmed by an experiment that, where the eyes of a human being continue to watch the same display pattern including an image in which the variation is little, if the peak luminance is decreased over a long period of time, then the drop of the peak luminance is little perceived. A specific condition confirmed through the experiment is described below.

(B-1) Example of an Optimum Condition

Figure 3:
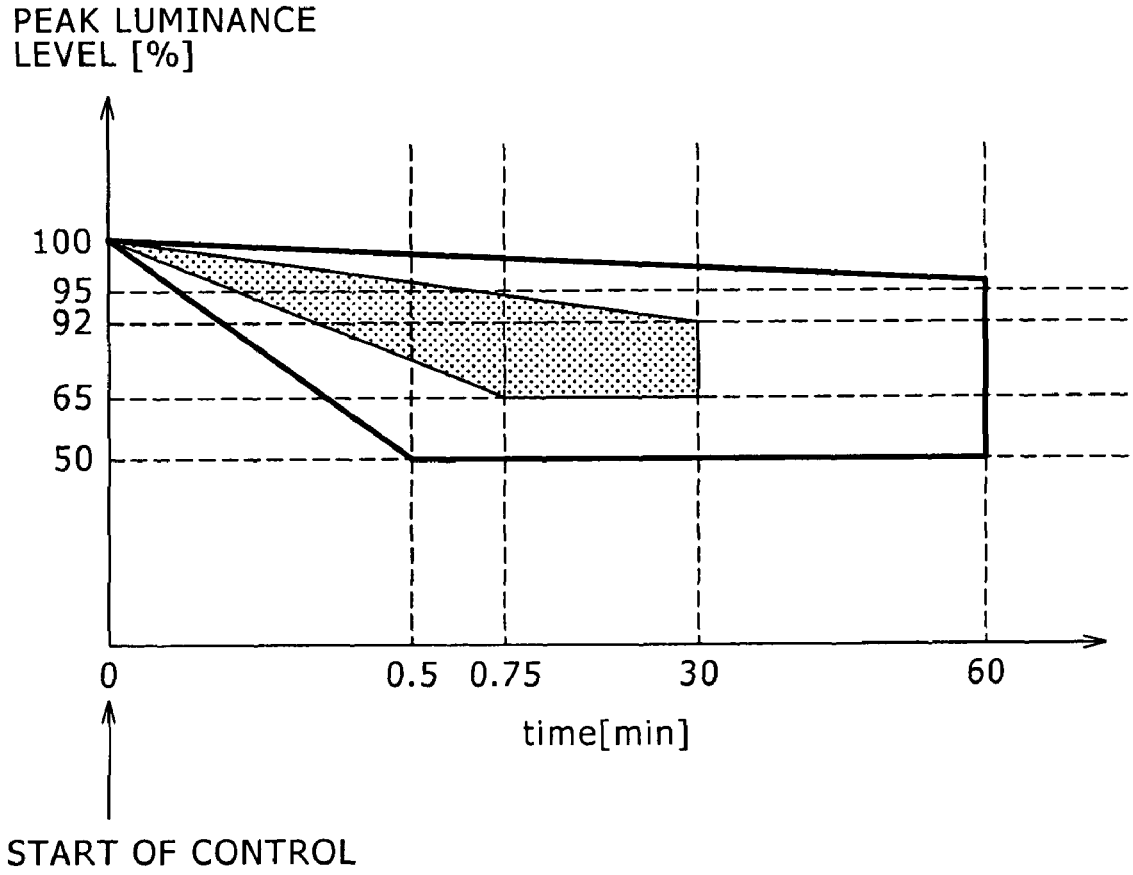
FIG. 3 is a diagram illustrating an example of a specific condition in which a drop of a physical peak luminance is not likely to be performed visually.

FIG. 3 illustrates an example of a physical optimum condition confirmed through the experiment by the inventors of the present invention. Particularly, in FIG. 3, the axis of abscissa indicates the time (minute) and the axis of ordinate indicates the peak luminance level of the light emission luminance where the maximum value of the gradation data that may be input is represented by 100%.

The optimum condition confirmed through the experiment by the inventors of the present invention is a range indicated by an outer framework of a thick line. The range of the optimum condition is given by a dropping speed after the control is started and a lower limit to the dropping amount after the control is started.

It is to be noted that the optimum condition described here does not signify that it is best for all audio-visual works or programs. Upon mounting, it is demanded to determine an optimum condition in response to the substance of the audio-visual work or program, or the characteristic, or a display panel or the like.

The inventors of the present invention propose to decrease the light emission luminance to 50% of the maximum peak value in 30 seconds as a maximum value of the dropping speed. The inventors further propose to decrease the light emission luminance to 95% of the maximum peak value (hence, by 5% of decreasing amount) in 60 minutes as a minimum value of the dropping speed.

Naturally, it is possible to make the dropping speed lower than the minimum value. In this instance, however, the intended effects of an increase of the life and a reduction of the power consumption may not be achieved significantly. Therefore, the condition specified as above is proposed.

On the other hand, even if the dropping speed is set higher than specified as above, there may be the possibility that no trouble may occur in practical use. However, if the dropping speed of the peak luminance becomes very high (consequently, the dropping amount becomes great), then the variation of the peak luminance becomes more likely to be perceived by the eyes of a human being. Therefore, such a very high dropping speed of the peak luminance is not very preferable.

If the peak luminance level is within the range surrounded by the outer framework shown in FIG. 3, then it is difficult for a human being to visually perceive a drop of the physical peak luminance.

It is to be noted that it is desired in practical use to use a dropping speed which is equal to or lower than the speed by which the peak luminance is dropped to 65% of the maximum peak value in 45 seconds but is equal to or higher than the speed by which the peak luminance is dropped to 92% of the maximum peak value in 30 minutes, as indicated by the netted range in FIG. 3.

Figure 4:
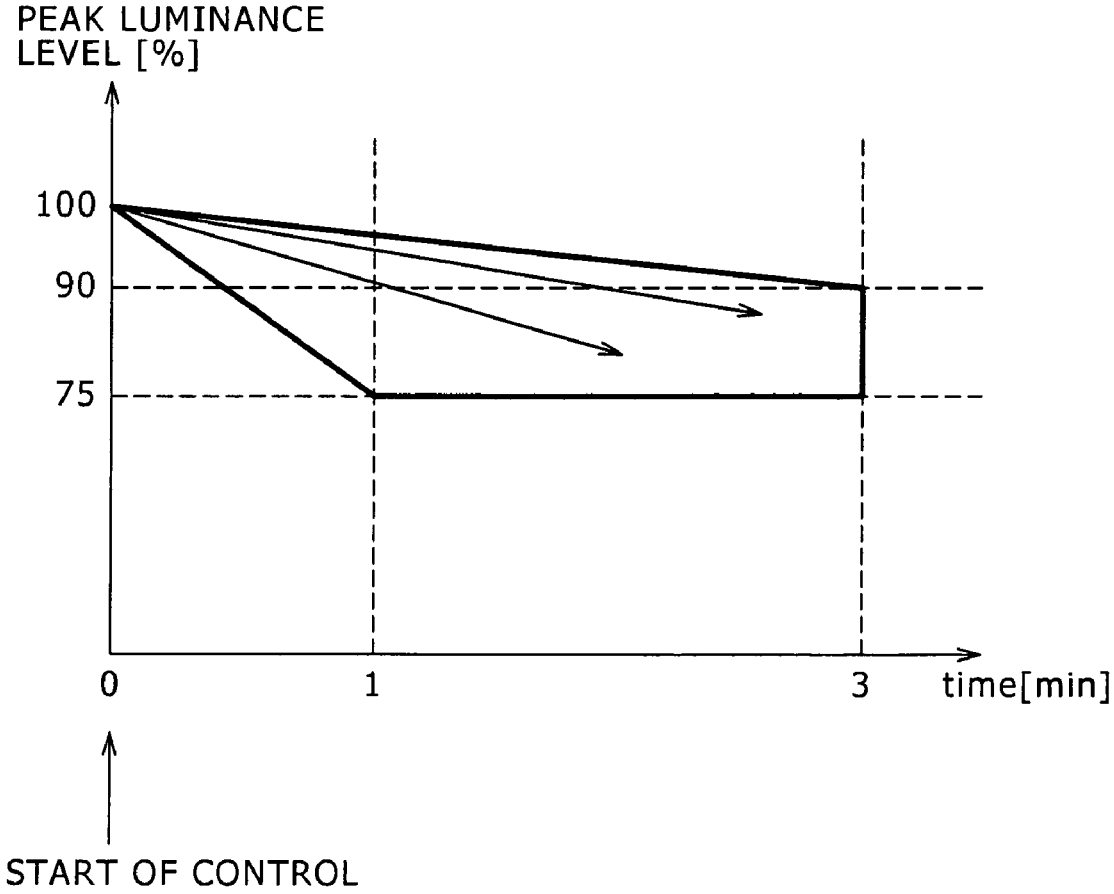
FIG. 4 is a diagram illustrating an optimum example of the specific condition.

More preferably, a dropping speed of the peak value is used which is equal to or lower than the speed by which the peak luminance is dropped to 75% of the maximum peak value in one minute but is equal to or higher than the speed by which the peak luminance is dropped to 90% of the maximum peak value in three minutes, as indicated by a range delineated by an outer framework of a thick line in FIG. 4. Dropping control within the range can be applied to almost all audio-visual data.

It is to be noted that, according to the experiment by the inventors of the present invention, the best result was obtained within a range of the dropping speed which is equal to or lower than the speed at which the peak luminance is dropped to approximately 90% of the maximum peak value in one minute but is equal to or higher than the speed at which the peak luminance is dropped to approximately 80% of the maximum peak value in three minutes.

Figure 5:
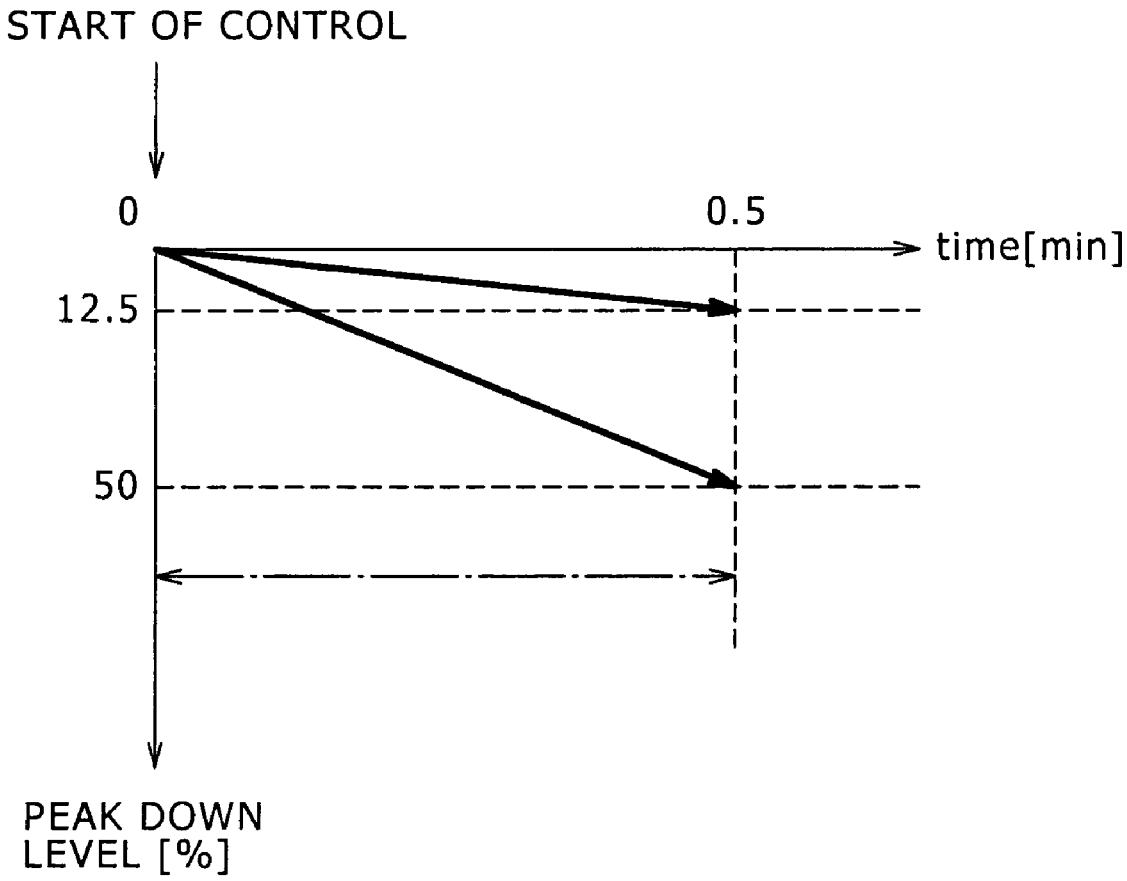
FIG. 5 is a diagram illustrating a restricting condition to the specific condition as viewed from a different point of view.

It is to be noted that such conditions may be provided with regard to the dropping speed. FIG. 5 illustrates an example of a condition wherein an upper value to the dropping speed is provided. The upper limit value to the dropping speed is given as a speed at which the peak luminance is dropped to 50% of the maximum peak value in 30 seconds, similarly as in the case of FIG. 3. Further, an optimum value is given by a speed at which the peak luminance is dropped to 12.5% of the maximum peak value in 30 seconds.

The satisfaction of the conditions given above is effective for the implementation of an increase of the life and a reduction of the power consumption of a display panel without allowing a user to perceive a drop of the picture quality caused by a drop of the peak luminance.

Incidentally, some exceptions may be included in the optimum range described above. For example, even if the peak luminance is dropped suddenly, if the drop occurs in a very short period of time, then a human being may not perceive the variation of the peak luminance.

Figure 6:
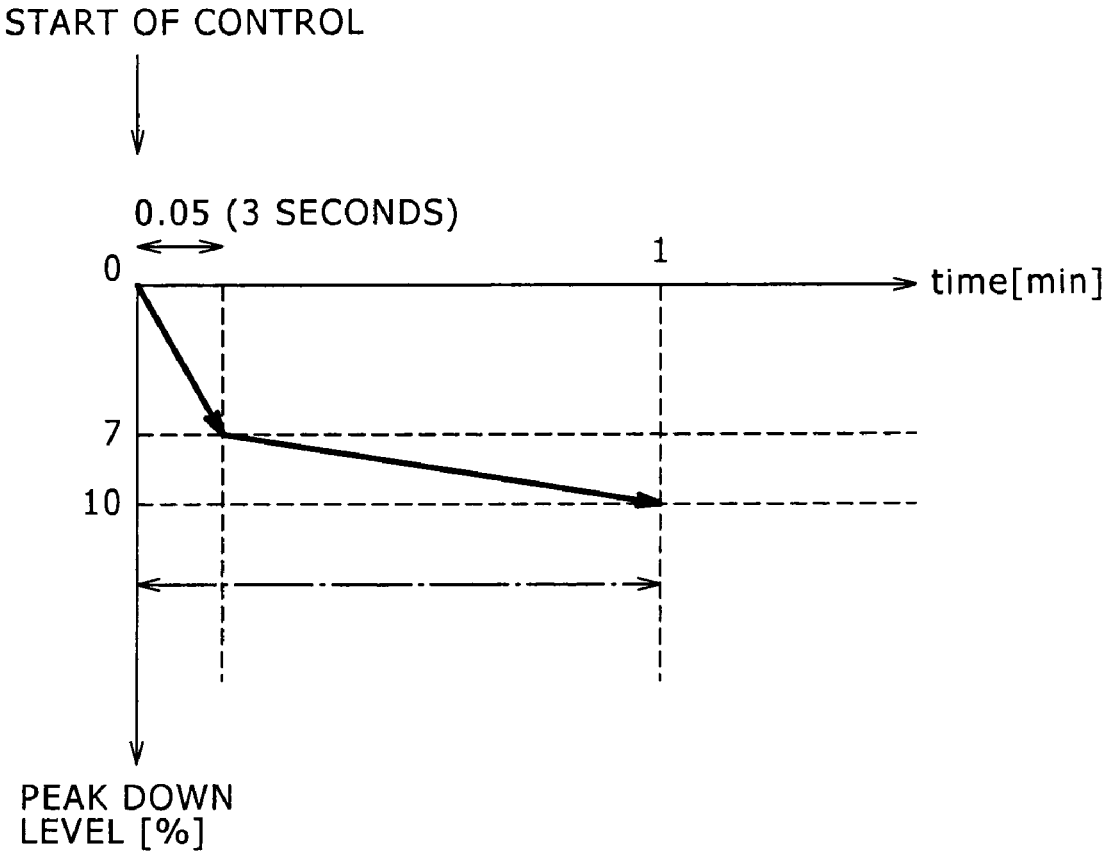
FIG. 6 is a diagram illustrating another optimum example of the specific condition.

FIG. 6 illustrates an example of such an optimum condition as just described. In the example of FIG. 6, the peak luminance is dropped to 93% of the maximum peak value in three seconds, and then it is dropped to 90% of the maximum value in one minute including the dropping amount in the preceding three seconds. The drop to 93% of the maximum value in three seconds corresponds, if it is converted into an amount in 30 seconds, to a drop of 30% of the maximum peak value.

In this manner, even if the peak luminance is instantaneously varied by a great amount, if the peak luminance is controlled so as to gradually decrease later, then the intended effect can be exhibited sufficiently.

It is to be noted that such a sudden dropping control of the peak luminance may be executed not only immediately after the dropping is started, but also at any point of time during the dropping control. In summary, the peak luminance may be suddenly varied temporarily if the dropping amount in a certain period of time of the dropping control is included in a certain range.

(C) Example of the Structure of the Organic EL Panel

Now, an example of a structure of an organic EL panel module which allows the dropping control of the peak luminance described above is described.

Figure 7:
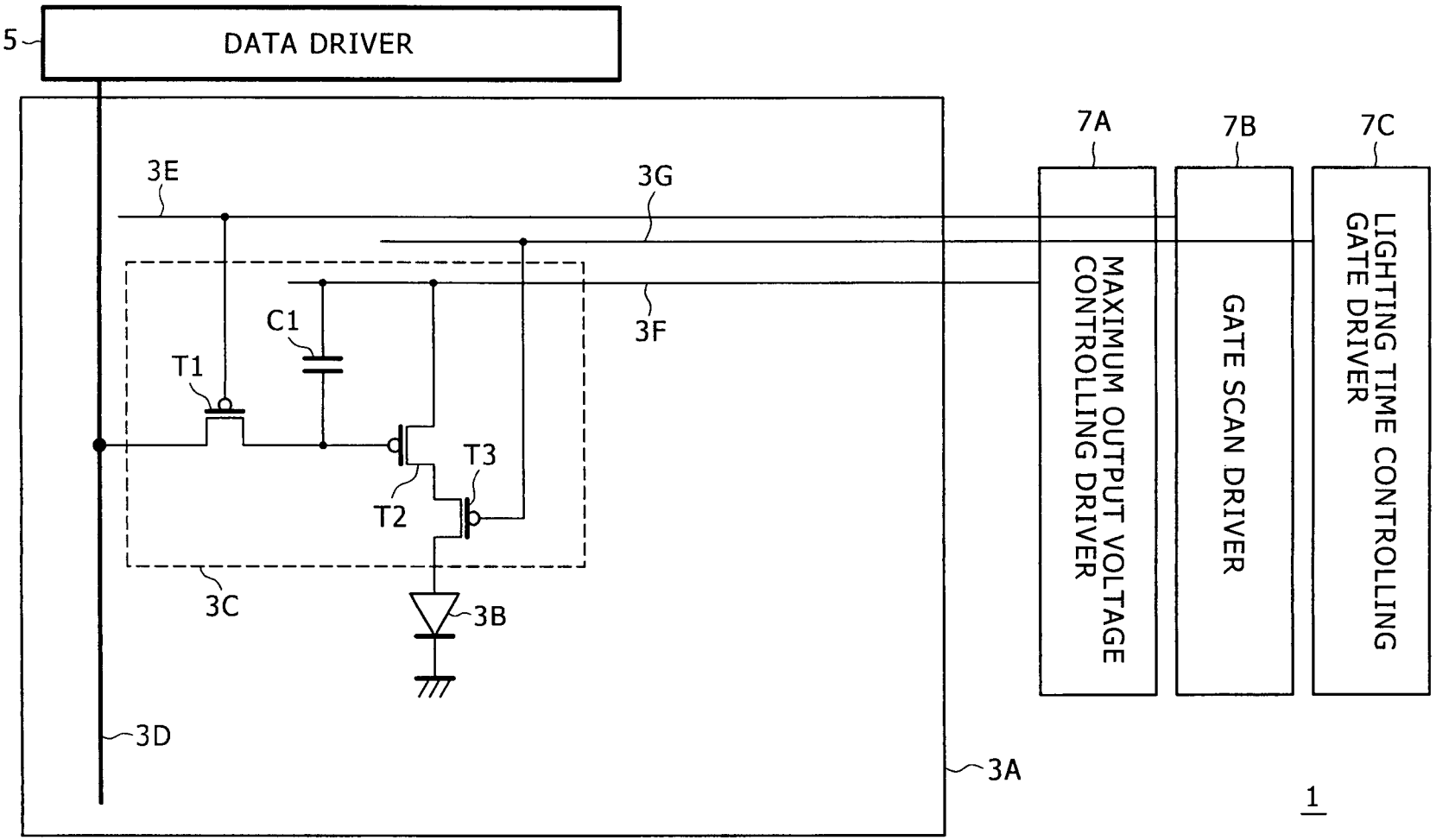
FIG. 7 is a block diagram showing an example of a structure of an organic EL panel module.

FIG. 7 shows an example of the structure of the organic EL panel module 1. Referring to FIG. 7, the organic EL panel module 1 includes a light emission region 3A (in which organic EL elements 3B are arrayed in a matrix) and a panel driving circuit for controlling the display of an image.

The panel driving circuit includes a data driver 5, a maximum output voltage controlling driver 7A, a gate scan driver 7B, and a lighting time controlling gate driver 7C. The panel driving circuit is formed at a peripheral portion of the light emission region 3A.

An organic EL element 3B corresponding to each pixel and a pixel driving circuit 3C for the organic EL element 3B are disposed at an intersecting point between each data line 3D and each scanning line 3E. The pixel driving circuit 3C includes a data switch element T1, a capacitor C1, a current driving element T2 and a lighting switch element T3.

The data switch element T1 is used to control the fetching timing of a voltage value provided through the data line 3D. The fetching timing is provided line-sequentially through the scanning line 3E.

The capacitor C1 is used to retain the fetched voltage value for a period of time of one frame. Plane-sequential driving is implemented by the use of the capacitor C1.

The current driving element T2 is used to supply current corresponding to the voltage value of the capacitor C1 to the organic EL element 3B. The driving current is supplied through a current supply line 3F. It is to be noted that a maximum output voltage Vmax is applied to the current supply line 3F through the maximum output voltage controlling driver 7A.

The lighting switch element T3 is used to control the supply of the driving current to the organic EL element 3B. The lighting switch element T3 is disposed in series to the supply path of the driving current. The organic EL element 3B emits light while the lighting switch element T3 keeps a closed state. On the other hand, while the lighting switch element T3 is open, the organic EL element 3B emits no light.

A lighting control line 3G supplies a duty pulse for controlling the opening and closing action of the lighting switch element T3. The duty pulse is illustrated in FIGS. 8B1 to 8Bn.

Figures 8A, 8B:
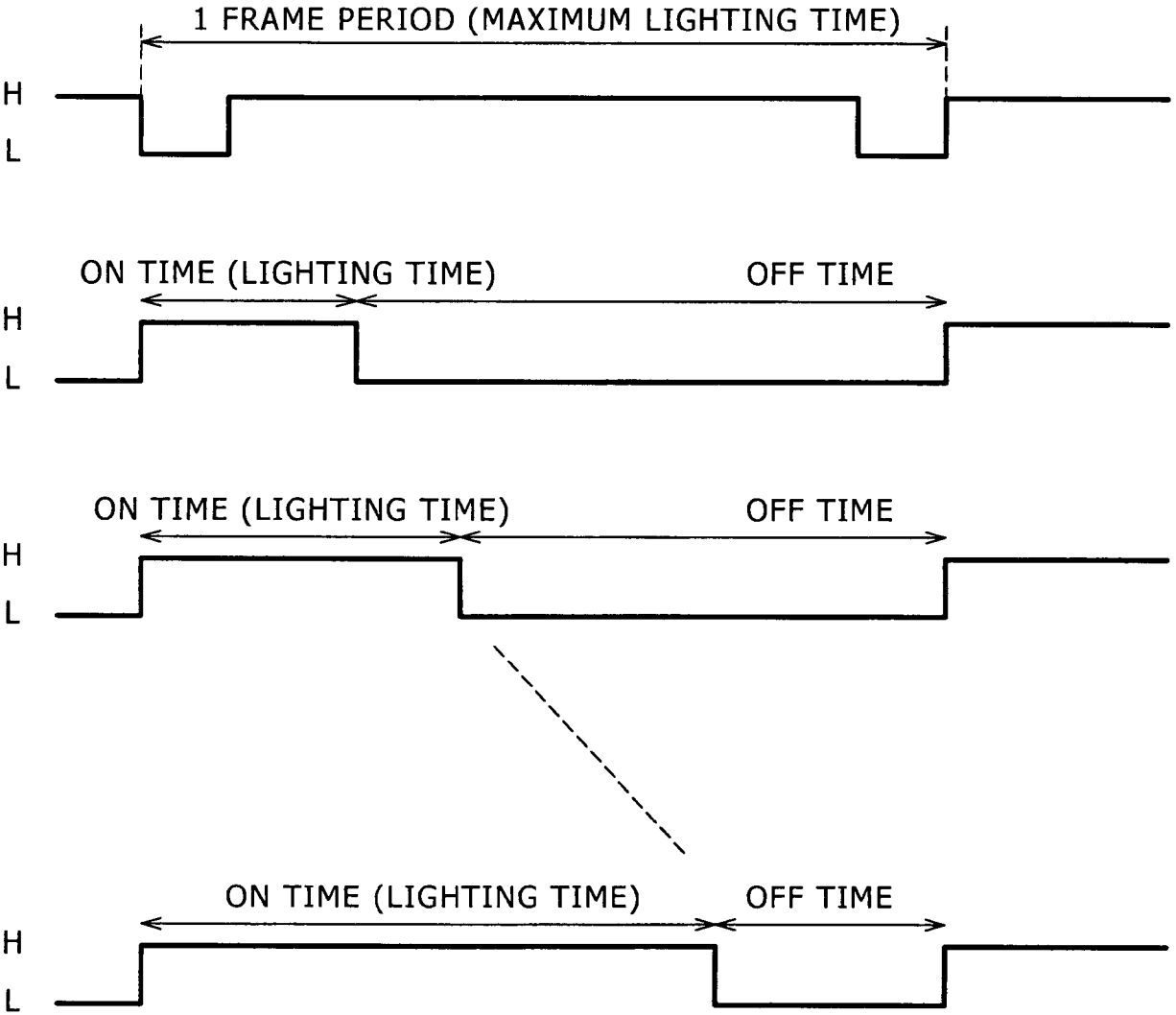
FIGS. 8A to 8Bn are waveform diagrams illustrating examples of a duty pulse for controlling the light emission time length.

It is to be noted that FIG. 8A illustrates a one-frame period as a reference time period. The light emission period by the duty pulse increases in the order of FIG. 8B1 to FIG. 8Bn.

Referring back to FIG. 7, the application control of the voltage to be applied to the current supply line 3F is executed by the maximum output voltage controlling driver 7A. On the other hand, the variation control of the light emission time period is executed by the lighting time controlling gate driver 7C. Such control signals for the drivers are supplied from a light emission condition control apparatus hereinafter described.

It is to be noted that, where the method of controlling the peak luminance with the light emission time period length is adopted, the maximum output voltage controlling driver 7A supplies a fixed voltage for all frames. On the other hand, where the method of controlling the peak luminance with the maximum output voltage Vmax is adopted, the lighting time controlling gate driver 7C supplies a duty pulse of a fixed ratio for all frames.

Figure 9:
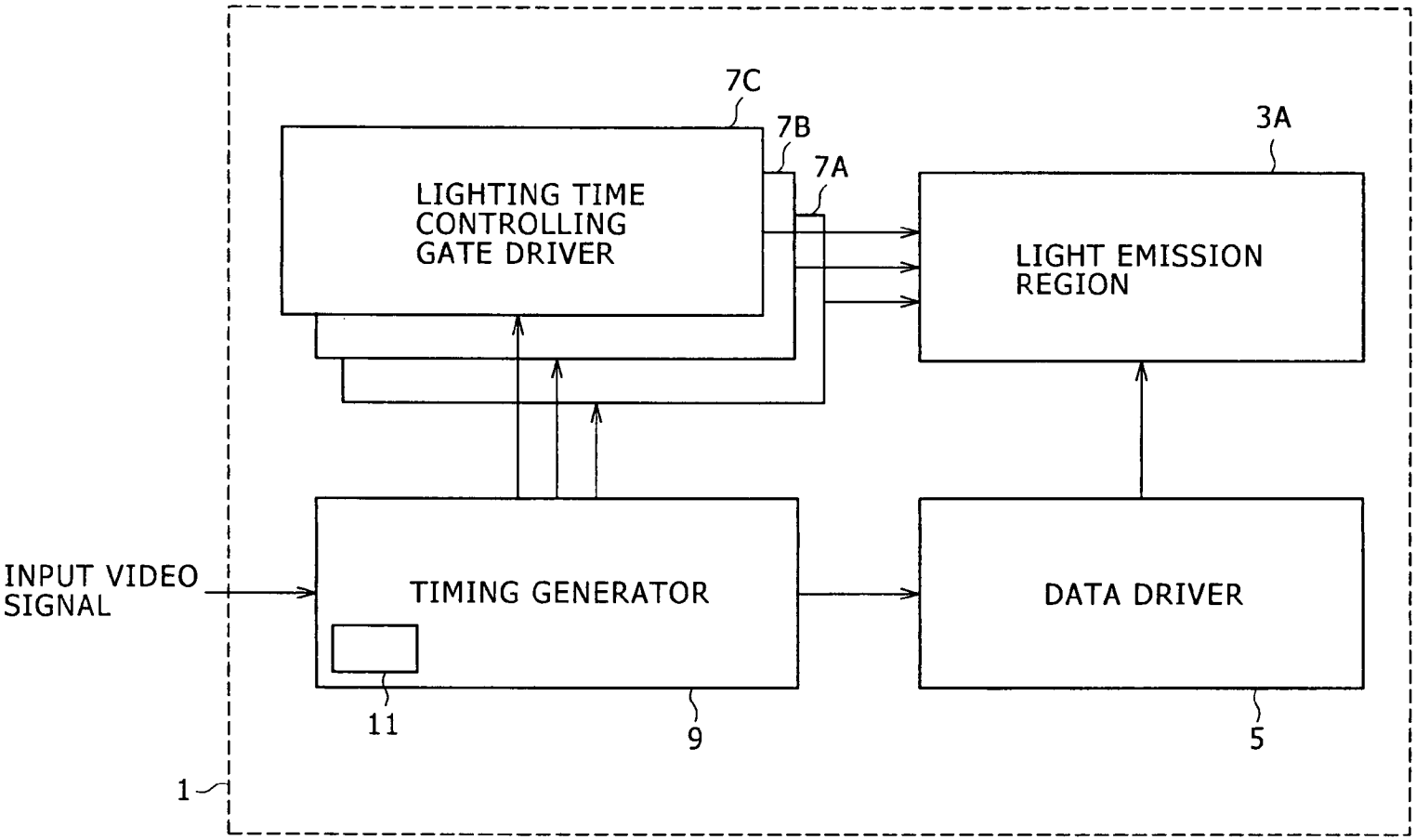
FIG. 9 is a block diagram showing the structure of the organic EL panel module and showing that a light emission condition control apparatus is incorporated in the organic EL panel module.

FIG. 9 shows an example of the structure of the organic EL panel module 1 which incorporates the light emission region 3A in which the pixel driving circuit 3C is formed. In the arrangement of FIG. 9, the light emission condition control apparatus 11 is mounted as part of a timing generator 9.

It is to be noted that a peripheral circuit of the light emission region 3A (the panel driving circuit) may be incorporated as a semiconductor, integrated circuit on a panel board or may be formed directly on a panel board using a semiconductor process.

(D) Examples of the Form of the Light Emission Condition Control Apparatus

Several examples of the form of the light emission condition control apparatus 11 shown in FIG. 9 which implements the dropping control of the peak luminance are described below.

(D-1) Form Example 1

Figure 10:
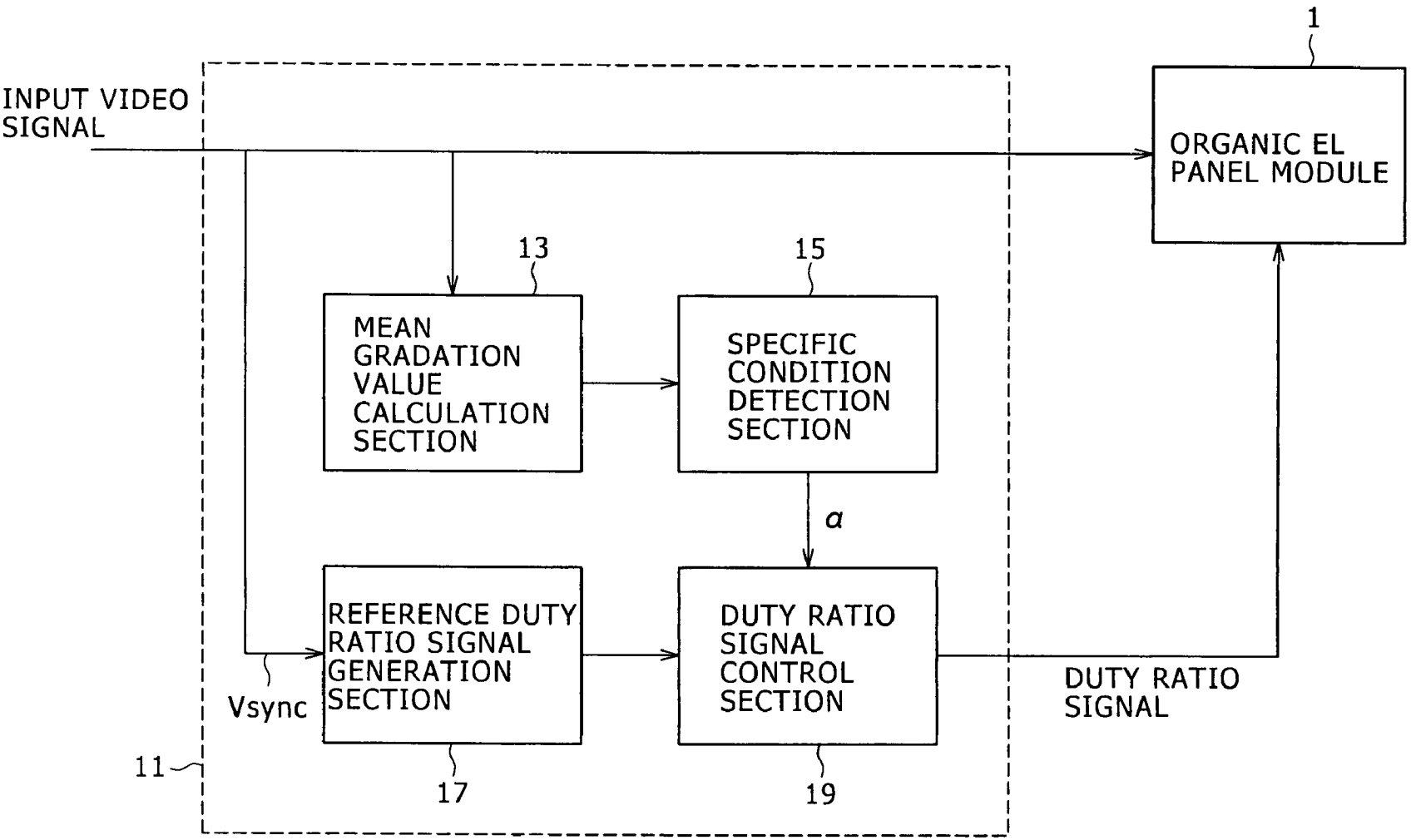
FIG. 10 is a block diagram showing a form example 1 of the light emission condition control apparatus.

FIG. 10 shows an example of a configuration of the light emission condition control apparatus 11 suitable for use in performing dropping control of the peak luminance through control of the light emission time period.

Referring to FIG. 10, the light emission condition control apparatus 11 includes a mean gradation value calculation section 13, a specific condition detection section 15, a reference duty ratio signal generation section 17 and a duty ratio signal control section 19.

The mean gradation value calculation section 13 is a processing device for calculating a mean gradation value APLn of a video signal for each one frame. It is to be noted here that the suffix n signifies time such as, for example, a frame number.

The specific condition detection section 15 is a processing device for detecting, based on a mean value Cn of mean gradation values APLn calculated over several frames, an input of a video signal which satisfies a specific condition in which a drop of a physical peak luminance is not likely to be perceived visually.

Here, the specific condition detection section 15 successively calculates the rate of change of the mean gradation value APLn of the latest frame with respect to the interval mean value Cn of the mean gradation values APLn calculated over a period of several frames. Then, if the rate of change calculated in this manner is lower than a threshold value B, then the specific condition detection section 15 decides that a frame which satisfies the specific condition has appeared.

Figure 11:
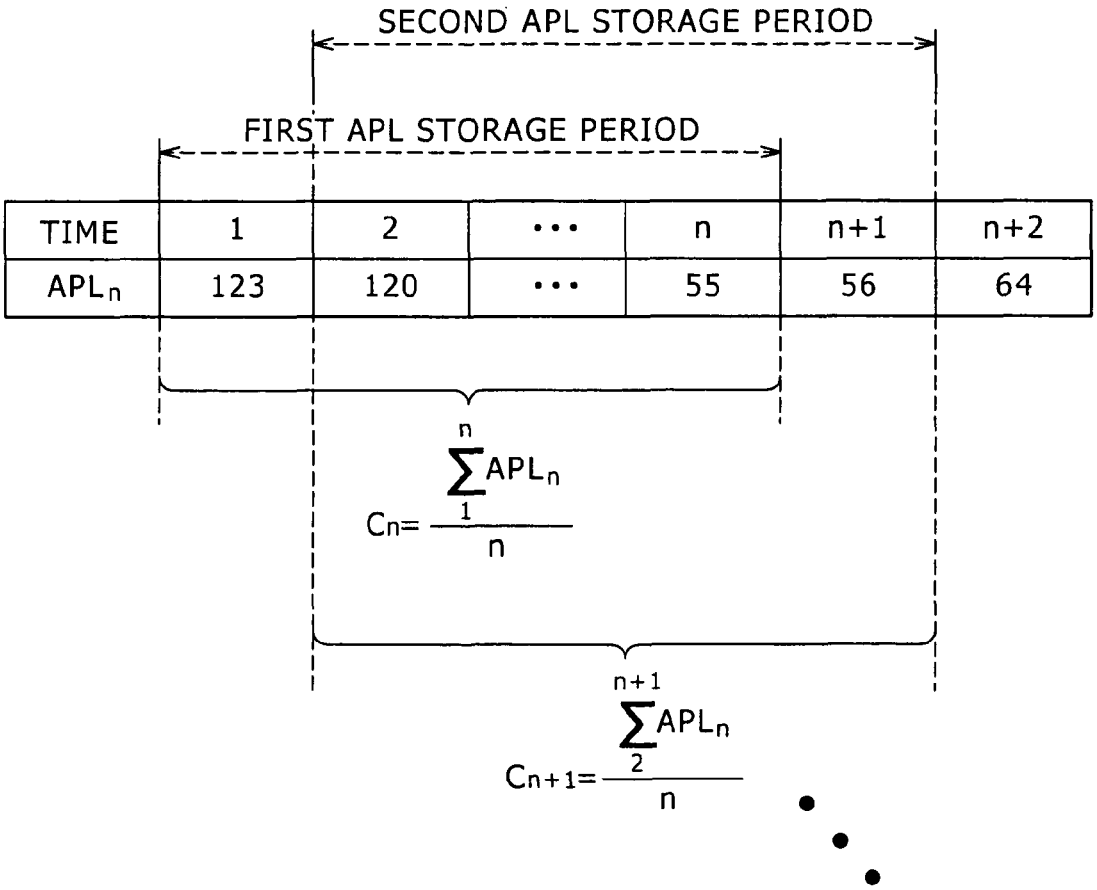
FIG. 11 is a view illustrating a principle of calculation of an interval mean value.

FIG. 11 illustrates a principle of calculation of the interval mean value Cn. Referring to FIG. 11, the specific condition detection section 15 stores the latest m mean gradation values APLi to APLi+m and divides the sum total of the mean gradation values APLi to APLi+m by the frame number m to calculate the interval mean value Cn. The suffix i here indicates time such as, for example, the frame number.

Figure 12:
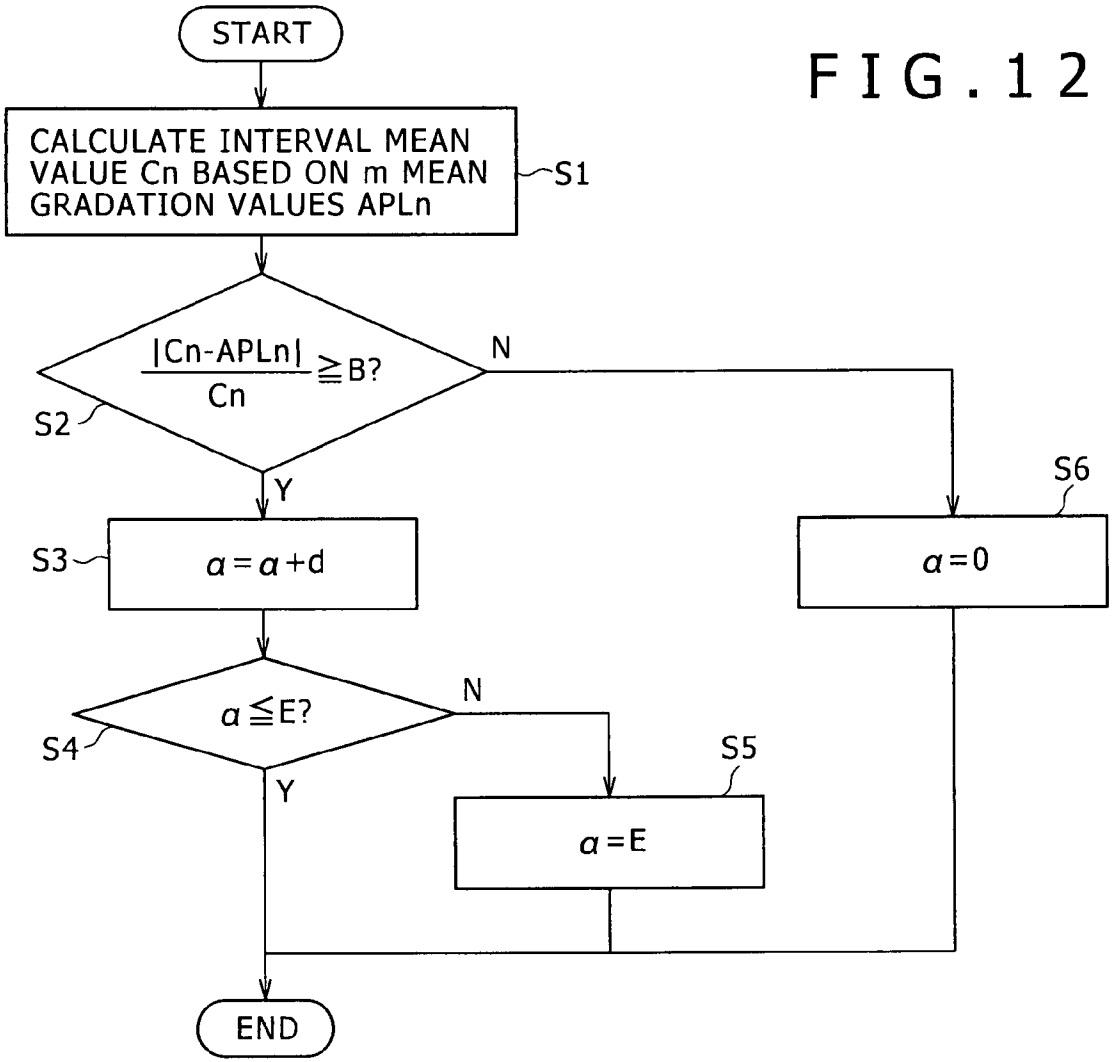
Figure 13:
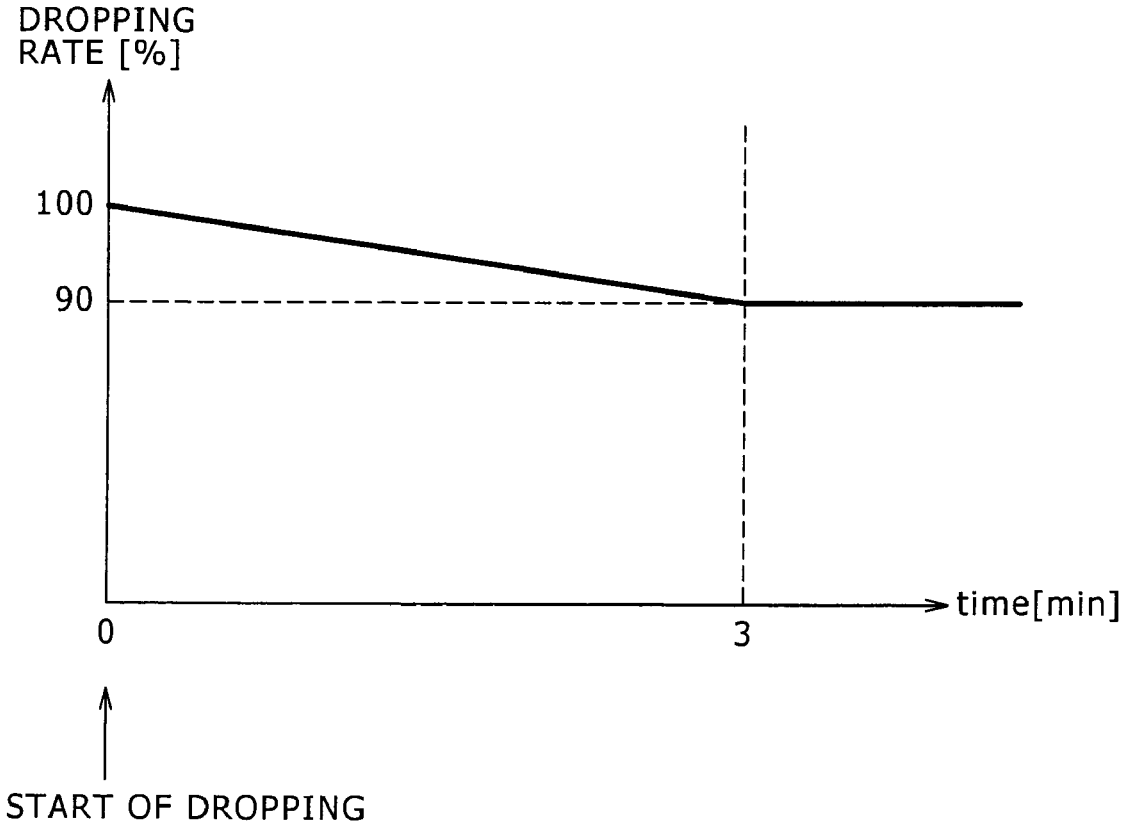
FIG. 13 is a diagram illustrating an example of the specific condition which is used in the form example 1.

FIG. 12 illustrates an example of a detection procedure of the specific condition executed by the specific condition detection section 15. It is to be noted that FIG. 12 illustrates the specific condition detection procedure where the peak luminance whose dropping control is executed after detection of the specific condition is dropped in accordance with a dropping condition illustrated in FIG. 13. FIG. 13 illustrates the dropping condition wherein the peak luminance is decreased at a fixed speed to 90% of the maximum peak luminance in three minutes.

Referring to FIG. 12, the specific condition detection section 15 first calculates the interval mean value Cn based on the latest m mean gradation values APL as described above at step S1. Then, at step S2, the specific condition detection section 15 divides the absolute value of the difference between the interval mean value Cn and the mean gradation value APLn of the current frame by the interval mean value Cn to calculate the rate of change and then decides whether or not the rate of change is equal to or higher than a threshold value B.

If the rate of change is equal to or higher than the threshold value B, then the specific condition detection section 15 obtains an affirmative result at step S2 and controls the peak luminance dropping function to an on state. On the other hand, if the rate of change is lower than the threshold value B, then the specific condition detection section 15 obtains a negative result at step S2 and controls the peak luminance dropping function to an off state.

In the present form example, the threshold value B is set to 10%.

Naturally, the threshold value B may be lower than 10%. However, if the threshold value B is excessively low, then the peak value also reacts with a changeover of the screen or with a very small change of the gradation mean value, resulting in an insufficient operation of the peak luminance dropping function. In other words, the threshold value B lower than 10% results in a failure to sufficiently exhibit the effect of the increase of the life of the display panel.

Or, the threshold value B may be higher than 10%. However, if the threshold value B is excessively high, then the peak luminance dropping function continues even after a changeover of the screen, and a display with the original peak luminance becomes less likely to be executed.

As described above, if a luminance variation by less than 10% with respect to the mean luminance in the latest frames is detected, then the specific condition detection section 15 renders the peak luminance dropping function operative to increment the dropping amount a % by a gradient d which satisfies the dropping condition of FIG. 13 at step S3.

However, since the upper limit E to the dropping amount $\alpha$ % is limited to 10%, the specific condition detection section 15 decides whether or not the dropping amount $\alpha$ % after updating is equal to or lower than the upper limit E at step S4. Then, if the dropping amount a % after updating exceeds the upper limit E, then the specific condition detection section 15 executes a process of restricting the dropping amount a % to the upper limit E at step S5.

Naturally, if the dropping amount a % after updating is equal to or lower than the upper limit E, the calculated dropping amount $\alpha$ % is provided as it is to the duty ratio signal control section 19.

On the other hand, if a luminance variation by more than 10% with respect to the mean luminance of the latest frames is detected, then the specific condition detection section 15 stops the peak luminance dropping function. In particular, the specific condition detection section 15 resets the dropping amount a % to zero at step S6.

The reference duty ratio signal generation section 17 executes a process of generating a reference duty ratio signal at a timing synchronized with a vertical synchronizing signal Vsync of the input video signal and providing the reference duty ratio signal to the duty ratio signal control section 19.

The duty ratio signal control section 19 generates a duty ratio signal by decrementing the time period corresponding to the lighting time period of the reference duty ratio signal by the dropping amount a %. The duty ratio signal control section 19 supplies the generated duty ratio signal to the organic EL panel module 1 (the lighting time controlling gate driver 7) of the organic EL panel module 1. The duty ratio signal control section 19 functions as a "light emission condition control section".

Thereupon, the duty ratio signal is given by pulse width modulating the lighting time period length of the reference duty ratio signal to $(100-\alpha)/100\%$. Accordingly, if the dropping amount a % is zero, then the reference duty ratio signal is outputted as it is as the duty ratio signal.

In this manner, if the light emission condition control apparatus 11 is incorporated which can gradually drop the peak luminance such that, where the difference between the mean luminance over the entire frame and the latest mean luminance is small, as long as this state continues, the peak luminance drops by 10% in three minutes, that is, it drops to 90% of the maximum peak luminance, then the life time of the display panel for a long period of time can be improved by approximately 10%.

Further, where the peak luminance dropping function is incorporated, the power consumption can be reduced by an amount corresponding to the dropping amount of the peak luminance.

Furthermore, the peak luminance dropping function exhibits a low arithmetic operation load also where it is implemented by a software process, and it can be implemented using a circuit of a very small scale also where it is implemented by an integrated circuit. Thus, the peak luminance dropping function is advantageous in incorporation into an organic EL panel module.

(D-2) Form Example 2

Figure 14:
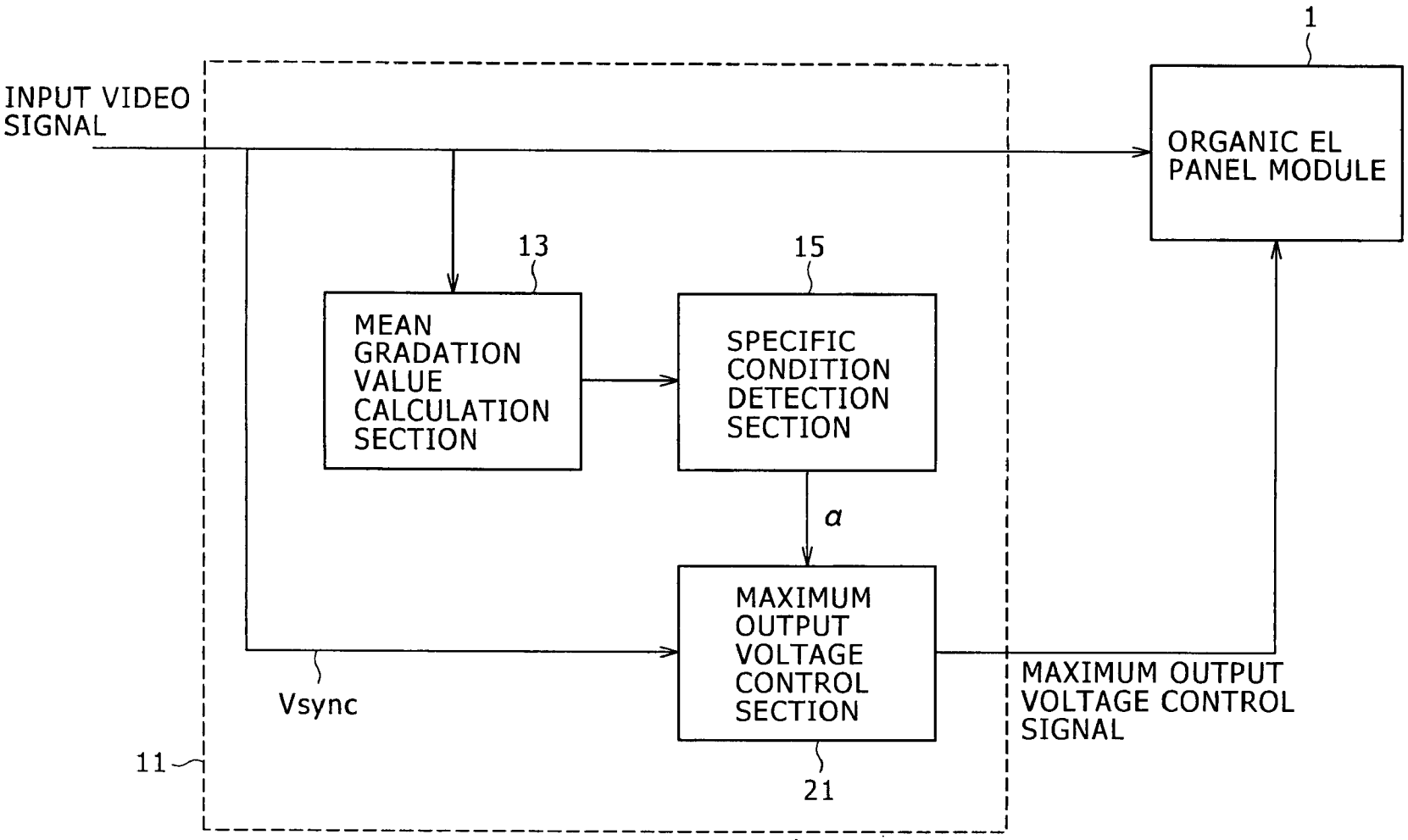
FIG. 14 is a block diagram showing a form example 2 of the light emission condition control apparatus.

FIG. 14 shows an example of a configuration of the light emission condition control apparatus 11 suitable for use in performing dropping control of the maximum output voltage Vmax to be applied to the current supply line 3F.

Referring to FIG. 14, the light emission condition control apparatus 11 shown includes a mean gradation value calculation section 13, a specific condition detection section 15, and a maximum output voltage control section 21. The mean gradation value calculation section 13 and the specific condition detection section 15 other than the maximum output voltage control section 21 are similar to those in the form example 1 of FIG. 10.

In particular, the specific condition detection section 15 determines the dropping amount a % for the peak luminance and provides the dropping amount a % to the maximum output voltage control section 21. In the present form example, the maximum output voltage control section 21 functions as a "light emission condition control section".

The maximum output voltage control section 21 generates a maximum reference voltage control signal at a timing synchronized with a vertical synchronizing signal Vsync of an input video signal and supplies the generated maximum reference voltage control signal to the organic EL panel module 1 (the maximum output voltage controlling driver 7A) of the organic EL panel module 1.

The maximum output voltage control signal is given basically as a value of $(100-\alpha)/100\%$ with respect to a reference value.

However, where the light emission luminance of the display elements do not vary in proportion to the maximum output voltage as seen in FIG. 2, a value determined by taking this into consideration is outputted as the maximum output voltage control signal.

In this manner, even where the technique of controlling the maximum output voltage Vmax so as to decrease while the light emission time period for one frame period is kept fixed, similar effects to those of the form example 1 can be anticipated.

(E) Other Form Examples (a) In the form examples described above, the organic EL panel module 1 incorporates both the maximum output voltage controlling driver 7A and the lighting time controlling gate driver 7C.

However, the peak luminance dropping control can be implemented by variably controlling any one of the light emission time period and the maximum output voltage. Accordingly, where the method of variably controlling the light emission time is adopted, a configuration which does not include the maximum output voltage controlling driver 7A may be adopted. On the other hand, where the method of variably controlling the maximum output voltage is adopted, another configuration which does not incorporate the lighting time controlling gate driver 7C may be adopted.

(b) In the form examples described above, one of the light emission time period and the maximum output voltage is variably controlled to control the peak luminance so as to decrease. However, it is also possible to vary both the light emission time period and the maximum output voltage simultaneously to reduce the peak luminance.

(c) In the form examples described above, the present invention is applied to an organic EL display panel. However, the present invention also can be applied also to an inorganic EL display panel.

(d) In the form examples described above, the light emission condition control apparatus 11 is mounted on an organic EL display panel.

However, such an organic EL display panel as described above or any other display apparatus may be in the form of a sole commodity or may be incorporated as part of some other image processing apparatus. For example, the device mentioned can be implemented as a display device for a video camera, a digital camera or other image pickup apparatus (including not only a camera unit but also an image pickup apparatus formed integrally with a recording apparatus), an information processing terminal (a portable computer, a portable telephone set, a portable game machine, an electronic notebook and so forth) and a game machine.

(e) In the form examples described above, the light emission condition control apparatus 11 is mounted on an organic EL display panel.

However, the light emission condition control apparatus 11 may be incorporated in an image processing apparatus side which supplies an input video signal to an organic EL display panel or other display apparatus. In this instance, a system for supplying a duty pulse or a voltage value from the image processing apparatus to the display apparatus may be adopted, or alternatively, another system wherein information indicating a duty pulse or a voltage value is supplied from the information processing apparatus to the display apparatus may be adopted.

(f) In the form examples described above, the light emission condition control apparatus 11 is described from the point of view of a functional configuration. However, it is a matter of course that equivalent functions can be implemented not only as hardware but also as software.

Further, all of the processing functions may be implemented as hardware or software, or part of the processing functions may be implemented using hardware or software. In other words, a combination configuration of hardware and software may be adopted.

(g) The form examples described hereinabove may be modified in various manners within the spirit and scope of the present invention. Further, also various modifications and applications may be created or combined based on the disclosure of the present invention.

While a preferred embodiment of the present invention has been described using specific terms, such description is for illustrative purpose only, and it is to be understood that changes and variations may be made without departing from the spirit or scope of the following claims.

What is claimed is:

1. A self-luminous display apparatus capable of varying a peak luminance of a display panel in a unit of at least one frame, comprising:

a mean gradation value calculation section configured to calculate a mean gradation value of an input video signal in a unit of at least one frame;

a specific condition detection section configured to detect, by comparing the mean gradation value of the current frame and mean gradation values averaged over a period of several frames, whether said input video signal satisfies a specific condition or not; and a light emission condition control section configured to perform dropping control of said peak luminance of said display panel in a unit of a frame based on at least the detection of said specific condition, wherein said peak luminance is continuously decreased by a predetermined speed while said specific condition is being satisfied, and wherein said predetermined speed is a constant speed being independent of said input video signal.

2. The self-luminous display apparatus according to claim 1, wherein said light emission condition control section is configured to perform dropping control of the peak luminance so that a dropping condition set in advance is satisfied for a period of time after a frame which satisfies the specific condition is detected until the detection state is cancelled.

3. The self-luminous display apparatus according to claim 1, wherein said specific condition detection section is configured to control the value of a voltage or current to be applied to a light emitting element in response to an image data value.

4. The self-luminous display apparatus according to claim 1, wherein said specific condition detection section successively calculates the rate of change of the mean gradation value of the current frame with respect to an interval mean value of the mean gradation values and detects the appearance of the frame which satisfies said specific condition when the calculated rate of change is lower than a threshold value.

5. The self-luminous display apparatus according to claim 1, wherein said peak luminance is decreased at a speed equal to or higher than a speed at which the peak luminance is decreased to 95% or less of a maximum peak value in one hour but is decreased at a speed equal to or lower than a speed at which the peak value is decreased to 50% of the maximum peak value in 30 seconds.

6. The self-luminous display apparatus according to claim 1, wherein said peak luminance is decreased at a speed equal to or higher than a speed at which the peak luminance is decreased to 92% or less of a maximum peak value in half an hour but is decreased at a speed equal to or lower than a speed at which the peak value is decreased to 65% of the maximum peak value in 45 seconds.

7. The self-luminous display apparatus according to claim 1, wherein said peak luminance is decreased at a speed equal to or higher than a speed at which the peak luminance is decreased to 90% or less of a maximum peak value in three minutes but is decreased at a speed equal to or lower than a speed at which the peak value is dropped to 75% of the maximum peak value in one minute.

8. The self-luminous display apparatus according to claim 1, wherein an upper limit value to said specific condition is given by a speed at which the peak luminance is decreased to 50% of the maximum peak value in 30 seconds.

9. The self-luminous display apparatus according to claim 1, wherein an upper limit value to said specific condition is given by a speed at which the peak luminance is decreased to 12.5% of the maximum peak value in 30 seconds.

10. The self-luminous display apparatus according to claim 1, wherein said specific condition permits provision of a period within which the peak luminance is decreased by 5% of the maximum peak value within three seconds while the peak luminance is decreased by 10% of the maximum peak value in one minute.

11. A light emission condition control apparatus for variably controlling a peak luminance of a display panel in a unit of at least one frame, comprising:

a mean gradation value calculation section configured to calculate a mean gradation value of an input video signal in a unit of at least one frame;

a specific condition detection section configured to detect, by comparing the mean gradation value of the current frame and gradation values averaged over a period of several frames, whether said input video signal satisfies a specific condition or not a light emission condition control section configured to perform dropping control of said peak luminance of said display panel in a unit of a frame based on at least the detection of said specific condition, wherein said peak luminance is continuously decreased by a predetermined speed while said specific condition is being satisfied, and wherein said predetermined speed is a constant speed being independent of said input video signal.

12. A light emission condition control method for variably controlling a peak luminance of a display panel in a unit of at least one frame, comprising:

calculating a mean gradation value of a video signal in a unit of at least one frame;

detecting, by comparing the mean gradation value of the current frame and mean gradation values averaged over a period of several frames, whether an input of the video signal satisfies a specific condition or not; and performing dropping control of the peak luminance of said display panel in a unit of a frame based on at least the detection of the specific condition, wherein said peak luminance is decreased by a predetermined speed while said specific condition is being satisfied, and wherein said predetermined speed is a constant speed being independent of said video signal.

13. A program stored in non-transitory tangible computer medium for causing a computer, which variably controls a peak luminance of a display panel in a unit of one frame, to perform operations comprising:

calculating a mean gradation value of a video signal in a unit of at least one frame;

detecting, by comparing the mean gradation value of the current frame and mean gradation values averaged over a period of several frames, whether an input of the video signal satisfies a specific condition or not; and performing dropping control of the peak luminance of said display panel in a unit of a frame based on at least the detection of the specific condition, wherein said peak luminance is decreased by a predetermined speed while said specific condition is being satisfied, and wherein said predetermined speed is a constant speed being independent of said video signal.

14. The light emission condition control apparatus according to claim 11, wherein said light emission condition control section is configured to perform dropping control of the peak luminance so that a dropping condition set in advance may be satisfied for a period of time after the frame which satisfies the specific condition is detected until the detection state is cancelled.

15. The light emission condition control method of claim 12, wherein performing dropping control comprises performing dropping control of the peak luminance so that a dropping condition set in advance may be satisfied for a period of time after the frame which satisfies the specific condition is detected until the detection state is cancelled.

16. The program of claim 13, wherein performing dropping control comprises performing dropping control of the peak luminance so that a dropping condition set in advance may be satisfied for a period of time after the frame which satisfies the specific condition is detected until the detection state is cancelled.

17. The self-luminous display apparatus according to claim 1, wherein said peak luminance is continuously decreased by said predetermined speed until a dropping amount of said peak luminance reaches a predetermined upper limit.

18. The light emission condition control apparatus according to claim 11, wherein said peak luminance is continuously decreased by said predetermined speed until a dropping amount of said peak luminance reaches a predetermined upper limit.

* * * * *